US005323630A

United States Patent [19]

Wenzel et al.

[11] Patent Number: 5,323,630

[45] Date of Patent: Jun. 28, 1994

[54] FLOW-ROLLER MACHINE

[75] Inventors: Helmut Wenzel, Beckum; Karl-Heinz Koestermeier, Reitberg, both of Fed. Rep. of Germany

[73] Assignee: Leifeld GmbH & Co., Fed. Rep. of Germany

[21] Appl. No.: 20,061

[22] Filed: Feb. 19, 1993

[51] Int. Cl.[5] ..... B21D 22/16

[52] U.S. Cl. ..... 72/83; 72/96

[58] Field of Search ..... 72/82, 83, 95, 96, 100

[56] References Cited

FOREIGN PATENT DOCUMENTS 008122 9/1956 Fed. Rep. of Germany ..... 72/83

2328387 1/1975 Fed. Rep. of Germany ..... 72/83

1652595 6/1979 Fed. Rep. of Germany ..... 72/83

*Primary Examiner*—Lowell A. Larson

*Attorney, Agent, or Firm*—Hill, Steadman & Simpson

[57] ABSTRACT

A flow-roller machine comprises a machine frame, a rotatable spindle, a rotary drive for the spindle, a compression tool attached to a face end of the spindle, an axially displaceable pressure pad aligning with the spindle for a workpiece put in place on the compression tool, and at least two rotatable compression rollers that, guided in the machine frame, can be advanced in radial direction of the spindle. The spindle together with its rotary drive and the pressure pad are displaceable in axial direction of the spindle relative to the machine frame and relative to the compression rollers.

14 Claims, 4 Drawing Sheets

FLOW-ROLLER MACHINE

BACKGROUND OF THE INVENTION

The present invention relates to improvements in flow roller machines where metal workpieces are cold worked rotationally by the application of cold working pressure by compression rollers.

The invention is directed to a flow-roller machine which includes a machine frame, a rotatable spindle, a rotary drive for the spindle, a compression tool attached to a face end of the spindle, an axially displaceable pressure pad aligning with the spindle for a workpiece put in place on the compression tool, and at least two rotatable compression rollers that, guided in the machine frame, can be advanced in the radial direction of the spindle.

Flow-roller machines of the this type are known and are widely utilized for cold-working of metallic workpieces. In standard flow-roller machines, one or more compression rollers are held at guides that allow both a displacement of the compression rollers in radial direction of the compression tool as well as in axial direction of the compression tool for the implementation of the flow-rolling process. The spindle is only rotatable but is non-dislocatably seated in axial direction.

What is considered disadvantageous in such a known flow-roller machine is that the placement of a workpiece blank to be worked onto the compression tool before the flow-rolling process and the removal of the completely worked workpiece from the compression tool at the end of the flow-rolling process are relatively complicated. This is true because the workpiece blank, when being put in placeand the finished workpiece, and when being removed, must respectively execute a compound motion both in radial direction of the compression tool as well as in axial direction of the compression tool. An automatic loading of the flow-roller machine thereby becomes technologically complicated and also requires a relatively long time, this reducing the productivity of the flow-roller machine.

An object of the invention is to provide a flow-roller machine wherein the placement of a workpiece blank onto the compression tool and the removal of the completely worked workpiece from the compression tool can be implemented more simply and in a shorter time, and whereby a high product quality is assured.

A further object of the invention is to provide an improved flow-roller machine which avoids disadvantages of structures heretofore available and provides a mechanism capable of producing improved workpieces. A further object of the invention is to provide an improved flow-roller machine wherein more accurate installation of the workpiece and the flow-rolling process can be achieved by a unique measuring arrangement for placement of the compression rollers.

FEATURES OF THE INVENTION

These objects are inventively achieved by a flow-roller machine for implementation of a flow-roller process, whereupon the spindle together with its rotary drive and the pressure pad are displaceable in axial direction of the spindle relative to the machine frame and relative to the compression roller or the compression rollers.

In the flow-roller machine of the invention, the placement of the workpiece blank to be shaped on the compression tool and the removal of the completely reshaped workpiece from the compression tool can be carried out in a significantly simplified way and at a quickened pace, as a result whereof the productivity of the flow-roller machine is advantageously enhanced.

For putting the workpiece blank, for example a precoined sheet metal round in place on the compression tool, it is now adequate to simply move the workpiece blank in radial direction of the spindle in front of the end face of the compression tool and to then bring the spindle together with the compression tool, from one side, and the aligning pressure pad, from the other side, against the workpiece blank in axial direction of the spindle until the latter is firmly clamped between the end faces of compression tool and pressure pad.

During the flow-rolling process, for which the compression rollers are brought into engagement with the circumference of the workpiece blank by being advanced in radial direction of the spindle, the main spindle together with the compression tool and workpiece blank and together with its rotary drive and the pressure pad is advanced in axial direction of the spindle until the shaping process has ensued, i.e. until the workpiece blank has been shaped to form the workpiece. The compression rollers thereby need not execute any motion in axial direction of the spindle and are only moved back in outward direction in radial direction of the spindle at the end of the flow-rolling process. Two or more compression rollers are usually uniformly distributed over the circumference of the spindle.

After the shaping process, the spindle together with its rotary drive are in turn retracted together, whereby the pressure pad is not retracted together with them. In order to remove the finished workpiece from the compression tool, it is adequate to firmly hold the workpiece so that it cannot co-execute the return motion of the spindle. The compression tool thus moves out of the arrested workpiece until the latter is free and the finished workpiece can be simply conveyed away in radial direction of the spindle. A movement of the workpiece in axial direction of the spindle is no longer required for removal from the compression tool. A new workpiece blank can then be immediately supplied in the way set forth above in the position of the flow-roller machine that is then achieved and the work sequence can be repeated. Based on practical trials, the clock time for the manufacture of a workpiece can be reduced by 5% through 20% with the new flow-roller machine.

A technologically simple flow-roller machine is achieved in one embodiment wherein the compression rollers are seated in a frame that is non-displaceable in axial direction of the spindle. Guides having only one motion direction, namely in radial direction of the spindle, are then merely required for the compression rollers.

In addition, the compression rollers can be adjustable in axial direction of the spindle relative to the frame and/or can be displaceable under load. For example, a mutual axial offset of the compression rollers given simultaneous attack at the workpiece can thus be set and corrected as needed.

The invention further proposes that a workpiece stripper is provided, this being freely displaceable with the spindle guided parallel to the spindle at the machine frame, whereby the displacement path of the workpiece stripper is limited such in return direction of the spindle that the displacement path of the workpiece stripper is shorter than the displacement path of the spindle. Given the return motion of the spindle, the workpiece stripper, after traversing a certain return path, is seated against the face edge facing the spindle at the workpiece that is still situated on the compression tool. What is achieved by the limitation of the displacement path of the workpiece stripper is that the workpiece stripper can no longer follow the motion after a further sub-distance in the return motion of the spindle. From this moment on, the workpiece is now in turn impeded by the workpiece stripper from following the return motion of the spindle and of the compression tool connected thereto. The workpiece stripper and the workpiece thus stand still, whereas the spindle together with the compression tool continue to be moved in return direction. The compression tool is thereby withdrawn from the workpiece until the workpiece is free. Advantageously, the workpiece stripper requires no separate drive means for its function, this contributing to low technical outlay and to a reliable function.

A development of the workpiece stripper provides that this is fashioned fork-shaped having at least two stripper fingers and that the stripper fingers comprise an articulated and/or elastic bearing for the compensation of asymmetries between the respective contact regions of workpiece and stripper fingers. This workpiece stripper assures that the stripper fingers always attack the workpiece with optimally identical force in the contact region with the workpiece even given asymmetries as can occur, for example, as a consequence of fluctuations in material thickness and the formation of ears connected therewith. This thereby prevents toeing of the workpiece when the pressure tool is withdrawn and damage to the workpiece is thus precluded. A corresponding flexibility of the stripper fingers can, for example, be achieved in that they are seated in the fashion of a rocker arm; an elastic bearing, for example, can be realized by a respective elastomer insert at every stripper finger.

It is also provided in the flow-roller machine of the invention that the rotary drive is connected to the spindle by transmission means that are arranged at the face end of the spindle to which the compression tool is also attached. What is achieved with this arrangement is that the drive force for the implementation of the flow-rolling process is transmitted onto the spindle extremely close to the compression tool. This simplifies the bearing of the spindle and enables the employment of less robustly dimensioned spindles because these need not transmit high torques over great lengths, as would be the case given a spindle drive at that end of the spindle facing away from the compression tool.

It is preferably provided in view of the drive of the spindle that the rotary drive is formed by an electric motor and that the transmission means are composed of two pulleys and a multiple or poly-V belt drive. A simple but reliable drive of the spindle is achieved with these means.

In order to enhance the removal of the completely shaped workpiece from the compression tool, a workpiece ejector that is axially displaceable relative to the spindle and to the compression tool can be centrally provided in the spindle and in the compression tool at the flow-roller machine of the invention. In order to remove the workpiece from the compression tool, the ejector can be displaced such with suitable actuation means, for example an hydraulically actuatable piston-cylinder unit, that the end face of the ejector facing toward the workpiece pushes the workpiece from the compression tool. This removal of the workpiece by the ejector can thereby optionally ensue alternatively to or in addition to the removal of the workpiece by the workpiece stripper.

In order to also be able to use the workpiece ejector for further employments, it is provided that said ejector comprises connecting means at its face end lying at the face side of the compression tool for the centered attachment of additional tool parts or measuring devices. A time-saving, module-like structure of the compression tool for adaptation to different workpieces to be manufactured on the flow-roller machine is possible with the additional tool parts. The flow-roller machine can be checked with the measuring devices, for example with respect to its adjustment and working precision and its wear, and can be readjusted and calibrated with reference to the test results.

The additional tool part is preferably a workpiece centering insert that sees to an exactly centered seating of the workpiece on the compression tool, as a result whereof the workpieces fabricated on the flow-roller machine are lent extremely good concentricity properties.

It is preferably provided in view of the measuring device that this comprises a measuring head and a measuring sensor in the form of a finger or of a disk and that, in particular, untruenesses of compression roller contours relative to the compression tool can thus be acquired. Such measuring heads are intrinsically known from other applications but can also be utilized in the flow-roller machine of the invention for testing and calibration thereof, whereby a suitable measuring sensor is then employed dependent on the desired measurement purpose. The measuring head, for example, can supply electrical measured signals that vary dependent on the degree of a deformation or excursion of the measurement sensor as occur given concentricity imprecisions of the compression roller and/or of the compression tool. After evaluation of these measurement sensor signals, a corresponding adjustment of the flow-roller machine or its parts can then ensue in order to again assure an exact calibration and, thus, a high product quality.

Other objects, advantages and features of the invention will become more apparent as will other embodiments which are intended to be covered herein, from the teaching of the principles of the invention in connection with the disclosure of the specification, claims and drawings, in which:

DESCRIPTION OF THE PREFERRED EMBODIMENTS

Figure 1:
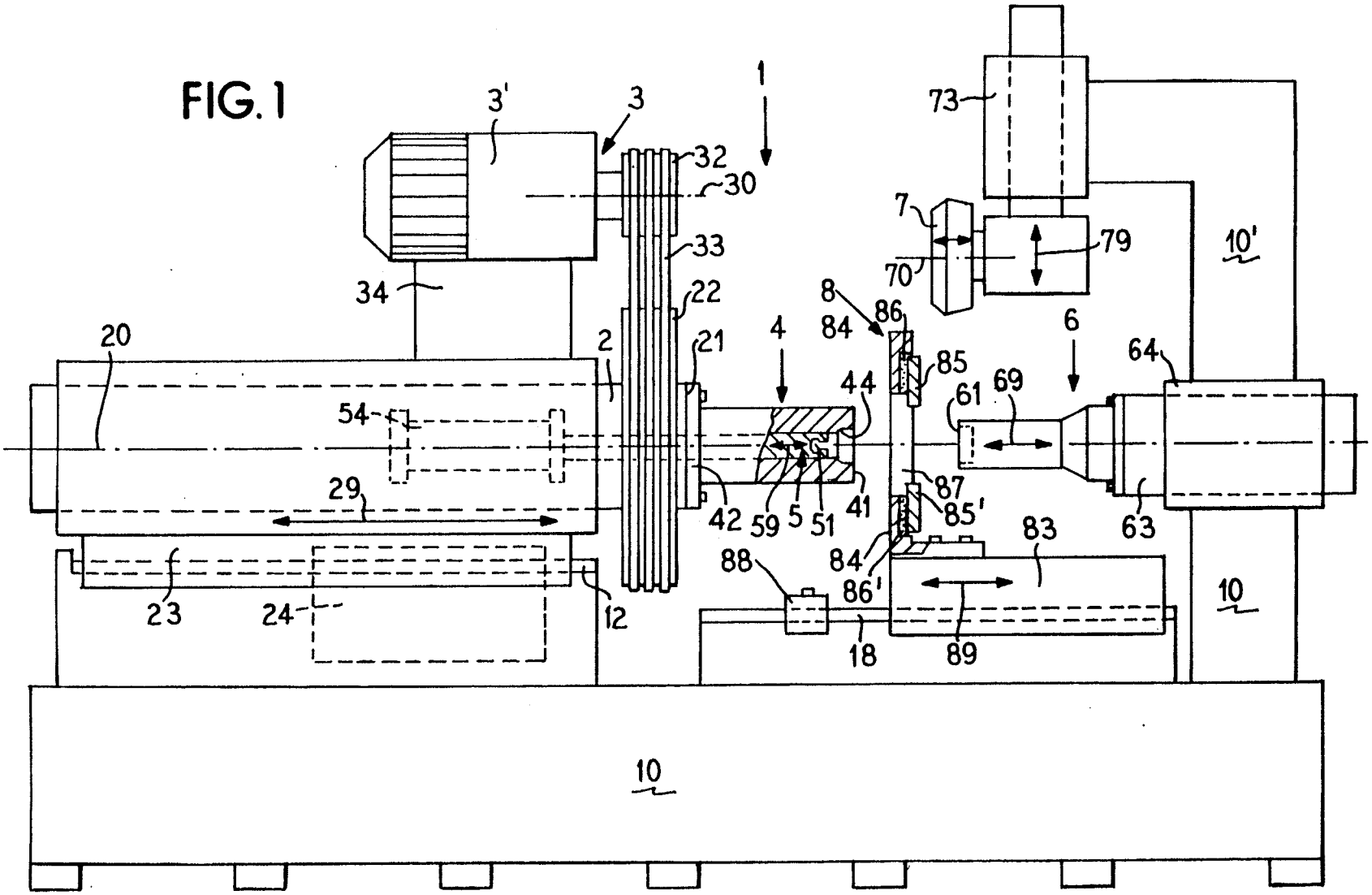
FIG. 1 is a somewhat schematic side elevational view with parts in fragmentary section of a flow-roller machine constructed and operating in accordance with the principles of the present invention.

As FIG. 1 of the drawing shows, the exemplary embodiment of the flow-roller machine 1 shown here has a machine frame 10 as its carrying part. A first guide 12 is constructed on the part of the machine frame 10 at the left in FIG. 1, a spindle carriage 23 being guided displaceably in the direction of the motion arrow 29 on this first guide 12. A carriage drive unit 24 is provided inside the guide 12 and under the spindle carriage 23 for the actuation of the spindle carriage 23. A spindle 2 that can be rotationally driven around a central rotational axis 20 is seated on the spindle carriage 23.

A rotary drive 3 serves the purpose of generating the rotational motion of the spindle 2, this rotary drive 3 being arranged above the spindle 2 and being composed of an electric motor 3' having a pulley 32 arranged on its rotary shaft 30, of a second pulley 22 arranged close to the right-hand end face 21 of the spindle 2, as well as of a belt drive 33 guided over the two pulleys 22 and 32 which is here composed of a total of three individual belts, for example V-belts or poly-V belts. An electric motor 3' is arranged in a motor carrier 34 that is arranged on the spindle carriage 23 together with the spindle 2 and can be displaced together therewith in the direction of the motion arrow 29.

An interchangeable compression tool 4 that has the form of a cylinder that is dynamically balanced relative to the rotational axis 20 of the spindle here is attached with a flange 42 to the right-hand end face 21 of the spindle 2 in FIG. 1.

A workpiece ejector 5 that extends up into the spindle 2 is centrally and coaxially guided in the interior of the compression tool 4. A hydraulically actuatable piston-cylinder unit 54 is provided inside the spindle 2, the workpiece ejector 5 being movable with this piston-cylinder unit 54 in axial direction of the spindle in the sense of the motion arrow 59. The ejector 5 has its free end, i.e. the right-hand end in FIG. 1, fashioned with connecting means 51, an under-cut, T-shaped channel in this case, that serve the purpose of attaching additional tool parts or other devices, particularly measuring instruments. A conical opening having an inside cone 44 is attached to the free, right-hand face side 41 of the compression tool 4 in FIG. 1, this serving the purpose of centering the said, additional tool parts or measuring instruments.

A second guide 18 on which a second carriage 83 is displaceable in axial direction of the spindle in the sense of the motion arrow 89 is arranged to the right next to the above-described guide 12 on the machine frame 10. A workpiece stripper 8 is attached to the carriage 83, this workpiece stripper 8 being composed of an annular carrier part 84 having a central opening 87 that is screwed to the carriage 83, and of two stripper fingers 85, 85'. An elastomer layer 86, 86' is provided between the carrier part 84 and every stripper finger 85, 85', these elastomer layers 86, 86' seeing to a certain relative mobility of the stripper fingers 85, 85' relative to one another and relative to the carrier part 84. The carriage 83 does not require a separate drive for the displacement; it is simply passively displaced here. The displacement path of the carriage 83 is limited by a detent 88 placed on the guide 18 in the motion direction toward the left. The detent 88 can be fixed at a suitable location on the guide 18 dependent on the purpose and use conditions of the flow-roller machine 1.

A part 10' of the machine frame 10 extends upwardly at the outer right-hand end of the flow-roller machine 1. A pressure pad 6 and two compression rollers are held at this part 10' of the machine frame 10, whereby only one compression roller 7 is visible in the drawing.

The pressure pad 6 is composed of an essentially cylindrical member that is rotatably seated in a guide 63 and is displaceable in axial direction of the spindle in the sense of the motion arrow 69. The center axis of the pressure pad 6 thereby aligns with the center axis 20 of the spindle 2 and of the compression tool 4. The left-hand end of the pressure pad 6 in FIG. 1 is fashioned with an end face, whereby this end face proceeds parallel to and concentrically relative to the end face 41 of the compression tool 4. The pressure pad 6 is provided with a suitable actuation means 64, for example an hydraulic piston-cylinder unit, for generating the displacement motion in the direction of the motion arrow 69.

Finally, the one of the two compression rollers 7 is visible in the upper right part of the flow-roller machine according to FIG. 1, this compression roller 7 being rotatable around a rotational axis 70 and being displaceable in the direction of the motion arrow 79 with a suitable guide and actuation means 73. The motion direction 79 thereby proceeds in a direction perpendicular to the rotational axis 20 of the spindle 2, i.e. in radial direction of the spindle. The compression roller 7 in this flow-roller machine 1 also has a displaceability in axial direction of the spindle. The second compression roller is identically fashioned and is arranged offset by 180° around the spindle axis 20 relative to the first compression roller 7. Three compression rollers 7 can also be provided, these then being preferably symmetrically arranged distanced by respectively 120° around the compression tool 4.

For manufacturing a workpiece on this flow-roller machine 1, a workpiece blank is first guided in radial direction of the spindle in front of the end face of the pressure pad 61. Following thereupon, the spindle 2 is advanced toward the right in axial direction of the spindle, whereby the compression tool 4 passes through the opening 87 of the workpiece stripper 8 until the end face 41 of the compression tool 4 is seated against the workpiece blank. Simultaneously, the pressure pad 6 is moved toward the left until the workpiece blank is firmly clamped between the end faces 41, 61 of compression tool 4 and pressure pad 6. The workpiece stripper 8 thereby has its stripper fingers 85, 85' lying to the left of the workpiece blank. For the implementation of the flow-roller process, the compression rollers 7 are advanced in radial direction of the spindle and the spindle 2 together with its rotary drive 3 and the compression tool 4 as well as the workpiece blank and the pressure pad 6 are then advanced toward the right until the flow-rolling process has been ended. Dependent on the length of the workpiece manufactured by the flow-rolling process, the feed motion is implemented to a correspondingly great distance, whereby the carriage 83 with the workpiece stripper 8 is passively moved together therewith toward the right as needed. At the end of the flow-rolling process, the compression rollers 7 are in turn retracted and the spindle 2 is displaced toward the left, whereby the workpiece still situated on the compression tool 4 entrains the workpiece stripper 8 toward the left until the carriage 83 of the latter runs against the detent 88. From this point on, the workpiece and the carriage 83 of the workpiece stripper 8 can no longer following the continued retraction motion of the spindle 2, as a result whereof the compression tool 4 is now withdrawn from the stationary workpiece. As soon as the workpiece is free, it can again be removed in radial direction of the spindle.

An exemplary sequence of a flow-rolling process shall be set forth in detail below with reference to FIGS. 2*a* through 2*f*, these showing various, critical work steps in the shaping. In all FIGS. 2*a* through 2*f*, the right-hand end of the spindle 2 is shown together with the compression tool 4 which are rotatable around the rotational axis 20. All FIGS. 2*a* through 2*f* also show a workpiece 9, the end of the pressure pad 6 and the one of two compression rollers 7, respectively shown in section. That part of the tool stripper 8 coming into contact with the workpiece 9 is also shown.

Figure 2A:
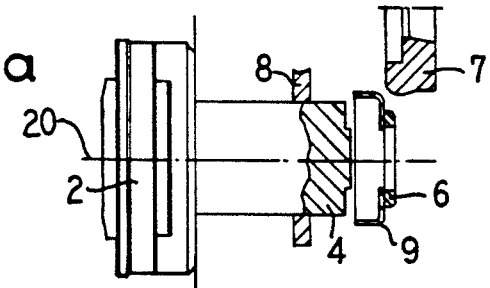
FIGS. 2A through 2F illustrate schematically a typical work sequence of the mechanism of the invention.
Figure 2B:
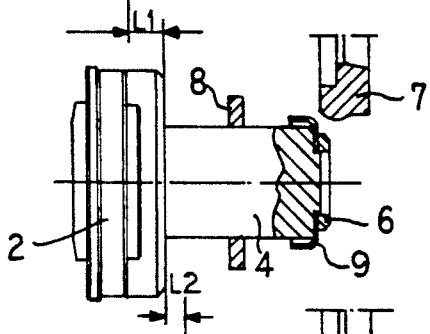

In the machine condition according to FIG. 2*a*, the compression tool 4 and the pressure pad 6 are distanced from one another, so that the blank of the workpiece 9 can be supplied in radial direction of the spindle. The compression rollers 7 are still disengaged from the workpiece 9 here. The workpiece stripper 8 surrounds the compression tool 4, likewise without having contact with the workpiece 9. The flow-roller machine proceeds from the condition according to FIG. 2*a* into the condition according to FIG. 2*b* by displacing the spindle 2 together with the compression tool 4 toward the right by the displacement path $L_1$. As a result thereof, the right end of the compression tool 4 is seated against the workpiece 9, as a result whereof the latter is firmly clamped between the compression tool 4 and the pressure pad 6.

Figure 2C:
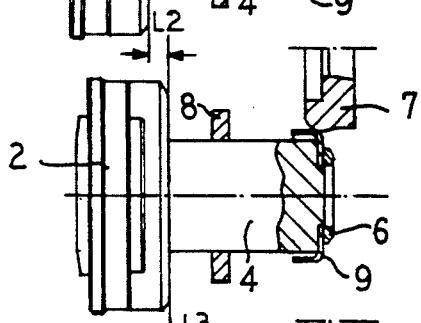
Figure 2D:
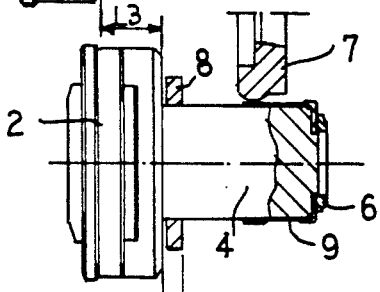

For implementing the reshaping of the workpiece 9 on the basis of the flow-roller process, the spindle 2 according to FIG. 2*c* is displaced toward the right by a further displacement path $L_2$, as a result whereof the compression rollers 7 enter into engagement with the circumferential region of the workpiece 9. The pressure pad 6 is now moved toward the right together with the spindle 2, whereby the clamping of the workpiece 9 is preserved. The workpiece stripper 8 continues to surround the compression tool 4 in that part not occupied by the workpiece 9, whereby the workpiece stripper 8 has hitherto retained its position.

After a further advance of the spindle 2 by a displacement path $L_3$ toward the right, the flow-rolling process has been concluded, the compression rollers 7 being returned toward the outside thereafter in the radial direction of the spindle. In the meantime, the workpiece stripper 8 has become seated against the face side of the spindle 2 and has been entrained by the latter by a portion of the displacement path toward the right.

Figure 2E:
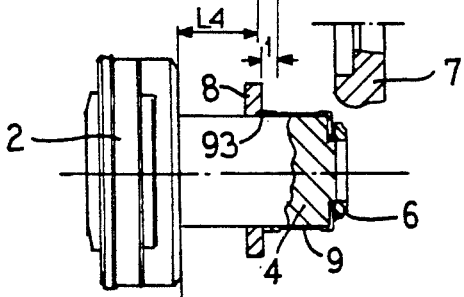
Figure 2F:
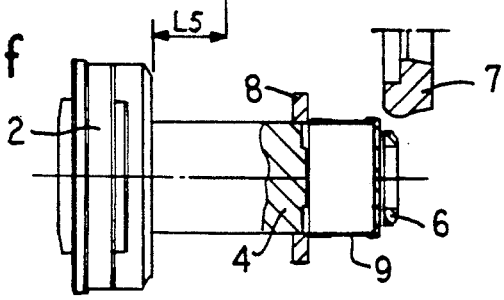

In order to now separate the completely shaped workpiece 9 from the compression tool 4, the spindle 2 is first moved back by a displacement path $L_4$, i.e. is moved toward the left in FIG. 2*e*, whereby the workpiece stripper 8 becomes seated against the left face edge 93 of the workpiece 9. The workpiece stripper 8 can follow the return motion of the spindle 2 by a certain displacement path 1 until the workpiece stripper 8, as set forth with reference to FIG. 1, runs up against the appertaining detent 88. From here on, the workpiece stripper 8 and the workpiece 9 can no longer follow the spindle 2 continuing to move toward the left by the displacement path $L_5$, as shown in FIG. 2*f*. As the transition from FIG. 2*e* to FIG. 2*f* shows, the compression tool 4 is thus withdrawn from the workpiece 9. Simultaneously, the return motion of the pressure pad 6 is limited toward the left, namely such that the pressure pad 6 again reaches its position according to FIG. 2*a*. The distance between the pressure pad 6 and the face end of the compression tool 4 is so great in the condition of the flow-roller machine shown in FIG. 2*f* that the completely shaped workpiece 9 which is now longer can nonetheless be unproblematically removed in radial direction of the spindle. A new workpiece blank can now be supplied and the work sequence can be repeated.

As a result of the delivery of the workpiece blank and the removal of the completely shaped workpiece that can be implemented purely in radial direction of the spindle, the clock time for the shaping of a workpiece can be greatly reduced because no movement of the workpiece blank and of the workpiece in axial direction of the spindle is required either when being introduced or when being removed.

Figure 3:
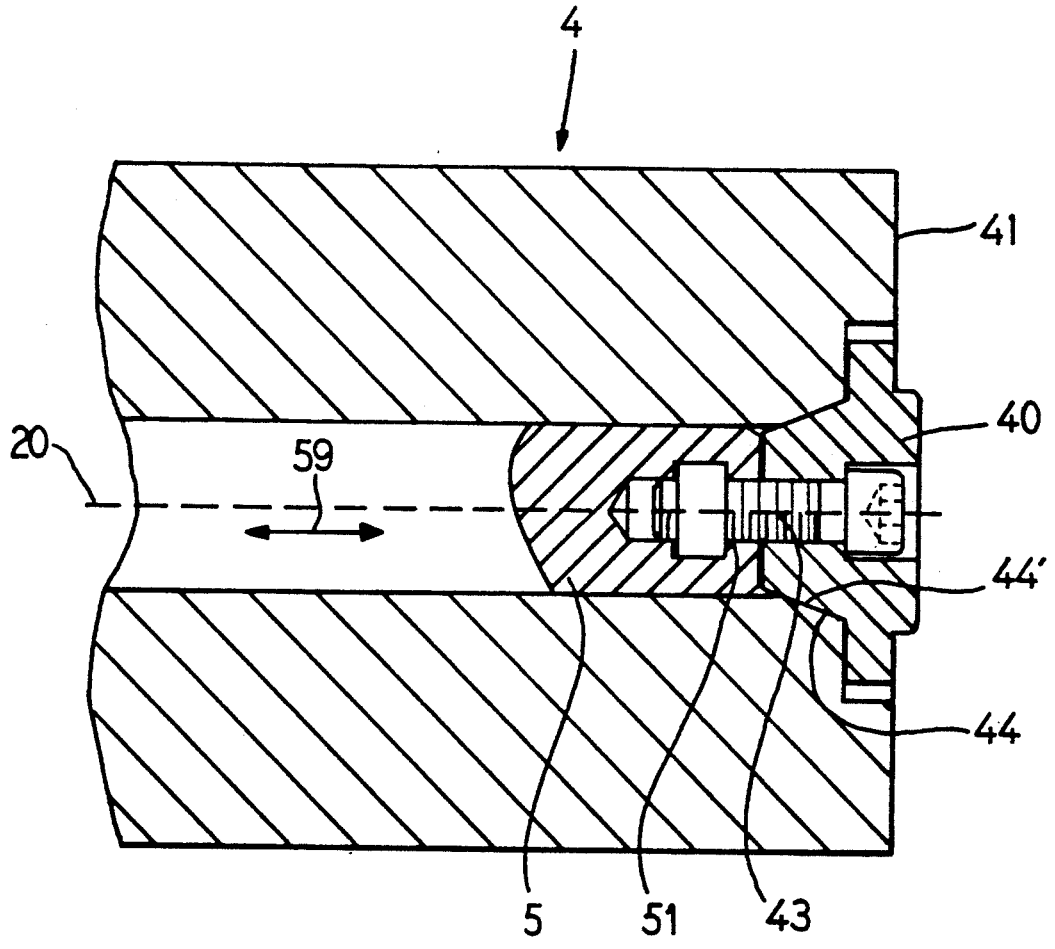
FIG. 3 is an enlarged fragmentary sectional view of the compression tool of the flow-roller machine.

FIG. 3 of the drawing shows the free end of the compression tool 4 in an enlarged, longitudinal section, whereby the right end of the workpiece ejector 5 is visible in the center of the compression tool 4. The workpiece ejector 5, just like the compression tool 4, is arranged concentrically relative to the rotational axis 20 of the spindle. As already explained in FIG. 1, moreover, the workpiece ejector 5 can be moved in axial direction in the sense of the motion arrow 59. The connecting means 51 may be seen at the right end of the ejector 5, these means 51 being fashioned in the form of an undercut, T-shaped channel which proceeds through the ejector 5 in a direction perpendicular to the plane of the drawing.

An additional tool part 40 is connected to the face end 41 of the compression tool 4 with the assistance of the connecting means 51 of the ejector 5. This additional tool part 40 in the illustrated example of FIG. 3 is a workpiece centering insert that has its central part projecting beyond the end face 41 of the compression tool 4 engaging into a correspondingly dimensioned clearance of the workpiece, thus centering the latter on the compression tool 4. In order to be able to exactly center the additional tool part 40 relative to the compression tool 4, an inside cone 44 is provided at the compression tool 4 and an outside cone 44' is provided at the additional tool part 40. The additional tool part 40 has its outside cone 44' pulled into the inside cone 44 of the compression tool 4 on the basis of a cap bolt 43 arranged between the end of the ejector 5 and the additional tool part 40 and is thereby chucked exactly centered.

Figure 4:
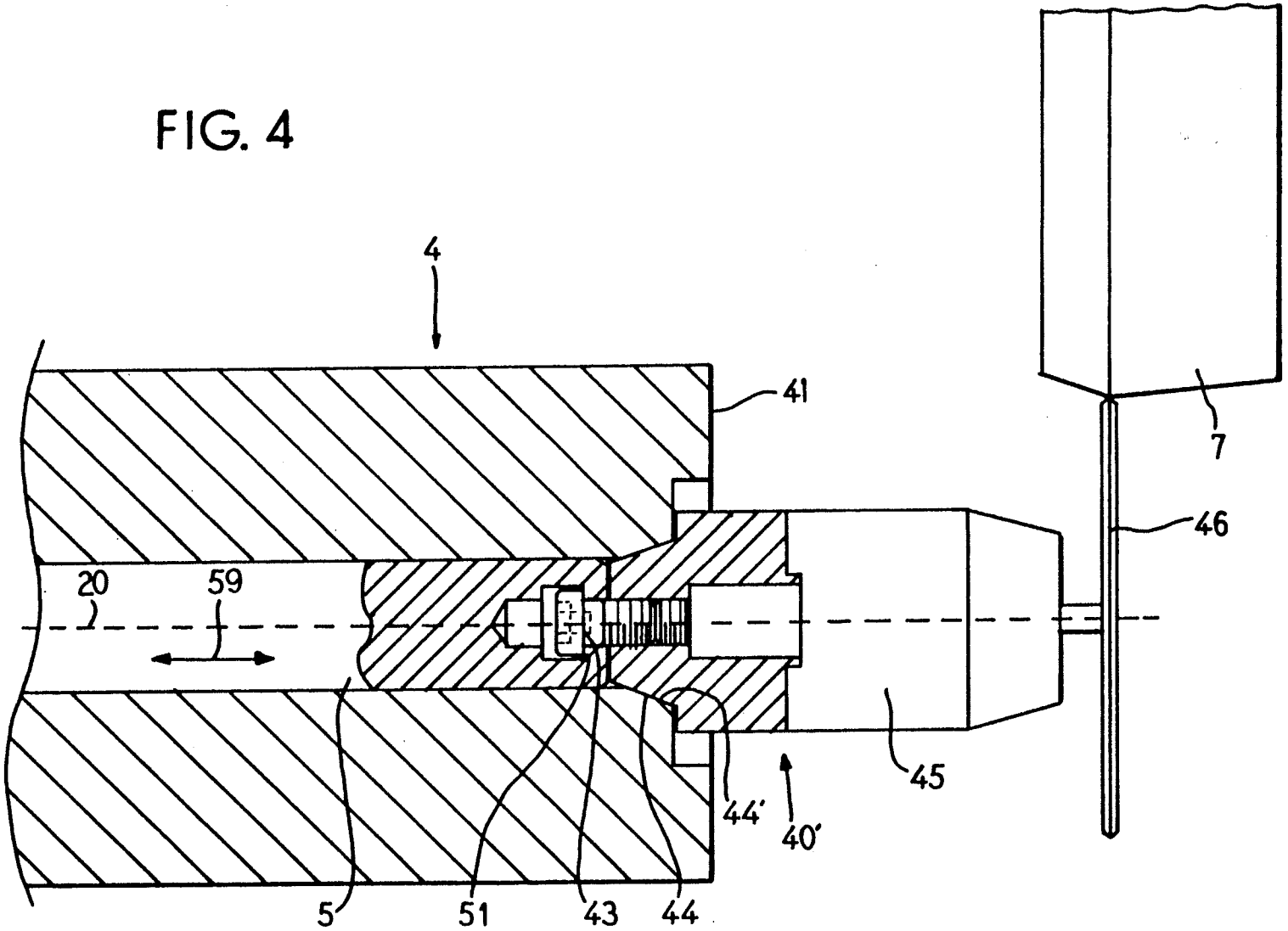
FIG. 4 is an enlarged fragmentary sectional view of the compression tool as illustrated in FIG. 3 with an attached measuring means.

FIG. 4 of the drawing shows an example of the attachment of a measuring instrument 40' to the compression tool 4 instead of the additional tool part 40 set forth above with reference to FIG. 3. The compression tool 4 here is unmodified in comparison to the compression tool set forth in FIG. 3; here, too, the ejector 5 that can be moved in reciprocating fashion in the direction of the motion arrow 59 is also situated concentrically in the inside of the compression tool 4. The face end 41 of the compression tool 4 is also fashioned with an inside cone 44 that serves the purpose of a central chucking of the measuring instrument 40'. To this end, the latter comprises a correspondingly shaped outside cone 44' that is again drawn firmly into the inside cone 44 on the basis of a cap bolt 43. The measuring instrument further comprises a measuring head 45 at whose outer end, i.e. at the right-hand end in FIG. 4, a measuring sensor in the form of a measuring disk 46 is arranged. The contour of the compression roller 7 can preferably be sensed with this measuring disk 46 in order to be able to undertake an adjustment and calibration of the flow-roller machine.

We claim:

1. A flow-rolling machine comprising in combination:

a machine frame;

a rotatable spindle rotatable about an axis;

a rotary drive for the spindle;

a compression tool attached to a face end of the spindle;

an axially displaceable pressure pad aligned with the spindle axis for a workpiece to be placed on the compression tool;

at least two rotatable compression rollers guided in the machine frame and capable of being advanced in radial direction relative to the spindle and rotatable about axes parallel to the spindle axis;

said spindle together with its rotary drive and the pressure pad being displaceable in axial direction relative to the spindle and relative to the compression rollers;

a tool stripper movable with the spindle and guided parallel thereto;

and means limiting the movement of the tool stripper in a return direction of the spindle away from said compression rollers such that a return path of the tool stripper is shorter than the return path of the spindle.

2. A flow-rolling machine constructed according to claim 1:

characterized in that the compression rollers are supported in a compression roller frame that is nonmovable in axial direction relative to the spindle.

3. A flow-rolling machine constructed according to claim 2:

characterized in that the compression rollers are adjustably displaceable under load in an axial direction relative to the spindle.

4. A flow-rolling machine constructed according to claim 1:

characterized in that the tool stripper is fork-shaped with at least two stripper fingers;

said stripper fingers being articulated for the compensation of asymmetries between the respective contact regions of a workpiece and the stripper fingers.

5. A flow-rolling machine constructed according to claim 1:

characterized in that the rotary drive is connected to the spindle by transmission means being located at the face end of the spindle at which the compression tool is attached.

6. A flow-rolling machine constructed according to claim 5:

characterized in that the rotary drive is provided by an electric motor and the transmission means are composed of pulleys and multiple belts.

7. A flow-rolling machine constructed according to claim 1:

including a workpiece ejector being axially displaceable relative to the spindle and relative to the compression tool and being centrally located on the spindle and relative to the compression tool.

8. A flow-rolling machine constructed according to claim 7:

characterized in that the workpiece ejector comprises connecting means at a face end of the compression tool for the centered attachment of additional tool parts for measuring instruments.

9. A flow-rolling machine constructed according to claim 8:

including an additional tool part comprising a workpiece centering insert.

10. A flow-rolling machine constructed according to claim 7:

including a measuring instrument comprising a measuring head and a measuring sensor so that untrue runnings of compression roller contours relative to the compression tool can be acquired therewith.

11. A flow-rolling machine comprising in combination:

a machine frame supporting a rotatable spindle for axial movement thereon;

a compression tool for supporting a workpiece attached to an end of the spindle;

an opposing pressure pad aligned with the spindle and movable axially relative to the spindle for supporting a workpiece therebetween at a work station;

a plurality of rotatable compression rollers radially offset from the work station and movable radially toward the work station for a flow rolling operation on a workpiece in the work station;

an annular tool stripper mounted on the spindle and axially displaceable relative thereto for ejecting a workpiece;

workpiece stripper fingers mounted on the annular stripper;

elastic means supporting the stripper fingers for accommodating lack of symmetry between the contact regions of the workpiece and the stripper fingers;

and means for moving the stripper axially relative to the spindle for ejecting the workpiece.

12. A flow rolling machine constructed in accordance with claim 11:

including a workpiece centering insert carried coaxially on the spindle and having a central portion projecting axially beyond the spindle.

13. A flow rolling machine constructed in accordance with claim 11:

including a conical face on the spindle facing the work station; and a tool part with a corresponding conical face supported on the spindle.

14. A flow rolling machine constructed in accordance with claim 13:

wherein said tool part supports a measuring disk operative for calibration at the work station.

* * * * *